US011273546B2

(12) United States Patent
Liaw

(10) Patent No.: US 11,273,546 B2
(45) Date of Patent: Mar. 15, 2022

(54) VALVE SEAT OF A PNEUMATIC HAMMER

(71) Applicant: Jian-Shiou Liaw, Taichung (TW)

(72) Inventor: Jian-Shiou Liaw, Taichung (TW)

( * ) Notice: Subject to any disclaimer, the term of this patent is extended or adjusted under 35 U.S.C. 154(b) by 445 days.

(21) Appl. No.: 16/529,953

(22) Filed: Aug. 2, 2019

(65) Prior Publication Data

US 2020/0238496 A1 Jul. 30, 2020

(30) Foreign Application Priority Data

Jan. 25, 2019 (TW) ..... 108102919

(51) Int. Cl.
*B25D 9/16* (2006.01)

(52) U.S. Cl.
CPC ..... *B25D 9/16* (2013.01); *B25D 2250/121* (2013.01)

(58) Field of Classification Search
CPC ..... B25D 9/16
See application file for complete search history.

(56) References Cited

U.S. PATENT DOCUMENTS 3,831,686 A * 8/1974 Brookman ..... B03C 3/766 173/132
4,074,777 A * 2/1978 Andersson ..... B25D 9/14 173/138
4,387,708 A * 6/1983 Davis ..... A61H 23/04 601/108
5,320,187 A * 6/1994 Pressley ..... B25D 17/04 173/15
5,564,510 A * 10/1996 Walter ..... E21B 4/14 175/296
6,832,605 B2 * 12/2004 Farrell ..... F41A 11/06 124/76
10,792,798 B2 * 10/2020 Liaw ..... B25D 9/16
2014/0083727 A1 * 3/2014 Gensmann ..... B25D 11/005 173/1
2014/0083728 A1 * 3/2014 Gensmann ..... B25D 9/16 173/1
2019/0072197 A1 * 3/2019 Liaw ..... F16K 25/005

FOREIGN PATENT DOCUMENTS

TW M568767 U 10/2018

* cited by examiner

*Primary Examiner* — Praachi M Pathak
(74) *Attorney, Agent, or Firm* — Alan D. Kamrath; Karin L. Williams; Mayer & Williams PC

(57) ABSTRACT

A valve seat has a first valve plate and a second valve plate detachably connected to the first valve plate. The first valve plate has a first trough and at least one pair of first dents, each pair including two first dents capable of respectively forming two first passages with a housing of a pneumatic hammer. The second valve plate has a second trough, at least one pair of second dents, at least one inlet tunnel, and at least two inlet channels. The second trough faces to and communicates with the first trough. Each pair of second dents includes two second dents capable of respectively forming two second passages with the housing. Each inlet tunnel is formed through the second valve plate and communicates with the two second passages. The at least two inlet channels communicate with the second trough and the at least one inlet tunnel.

19 Claims, 9 Drawing Sheets

VALVE SEAT OF A PNEUMATIC HAMMER

BACKGROUND OF THE INVENTION

1. Field of the Invention

The present invention relates to a pneumatic device, and more particularly to a valve seat being capable of increasing flow of compressed gas passing through the valve seat to make a valve disk agilely move within the valve seat.

2. Description of Related Art

A conventional pneumatic hammer capable of rapidly detaching and mounting a chisel as disclosed in Taiwan patent M568767 has a valve seat. With reference to FIGS. 2 and 5 of M568767, the valve seat has a rear valve plate, a front valve plate connected to the rear valve plate, and a valve disk disposed within the rear valve plate and the front valve plate. The valve disk 43 disposed within the rear valve plate 41 and the front valve plate 42 is driven by compressed gas to move reciprocatively.

When the valve disk driven by compressed gas moves forward and blocks an outlet passage of the front valve plate, the compressed gas entering from an inlet passage of the rear valve plate enters an annular space between a cylinder and a main body via two communicating tunnels and two exhaust tunnels of the rear valve plate. The compressed gas passes through two entering tunnels and two communicating tunnels to drive the valve disk to move backward and to push the valve disk to block the inlet passage and the two communicating tunnels. The compressed gas enters the inlet passage and pushes the hammer forward.

However, the front valve plate only has two communicating tunnels and the compressed gas passing through the two communicating tunnels cannot provide the valve disk with a sufficient force to move back. Moreover, the compressed gas passing through the two communicating tunnels cannot provide the valve disk with even forces to smoothly move back. The valve disk is likely to be wedged during movement. In addition, the annular space disposed between the cylinder and the main body is small, and thereby flow of the compressed gas is too small to push the valve disk. Reasons mentioned above are why the valve disk cannot agilely move within a moving space within the rear valve plate and the front valve plate. Those reasons cause malfunctions of the conventional pneumatic hammer disclosed in Taiwan patent M568767.

To improve the core material of the conventional pneumatic hammer, the present invention provides a valve seat of the pneumatic hammer to mitigate or obviate the aforementioned problems.

SUMMARY OF THE INVENTION

The main objective of the present invention is to improve the movement of a valve disk disposed within a valve seat and make the valve disk agilely reciprocate inside the valve seat.

The valve seat of the present invention comprises a first valve plate and a second valve plate detachably connected to the first valve plate. The first valve plate has a first trough and at least one pair of first dents. Each pair of first dents includes two first dents capable of respectively forming two first passages with a housing of a pneumatic hammer. The second valve plate has a second trough, at least one pair of second dents, at least one inlet tunnel, and at least two inlet channels. The second trough faces to and communicates with the first trough. Each pair of second dents includes two second dents capable of respectively forming two second passages with the housing. Each inlet tunnel is formed through the second valve plate and communicates with the two second passages. The at least two inlet channels communicate with the second trough and the at least one inlet tunnel.

Other objects, advantages, and novel features of the invention will become more apparent from the following detailed description when taken in conjunction with the accompanying drawings.

DETAILED DESCRIPTION OF PREFERRED EMBODIMENTS

Figure 1:
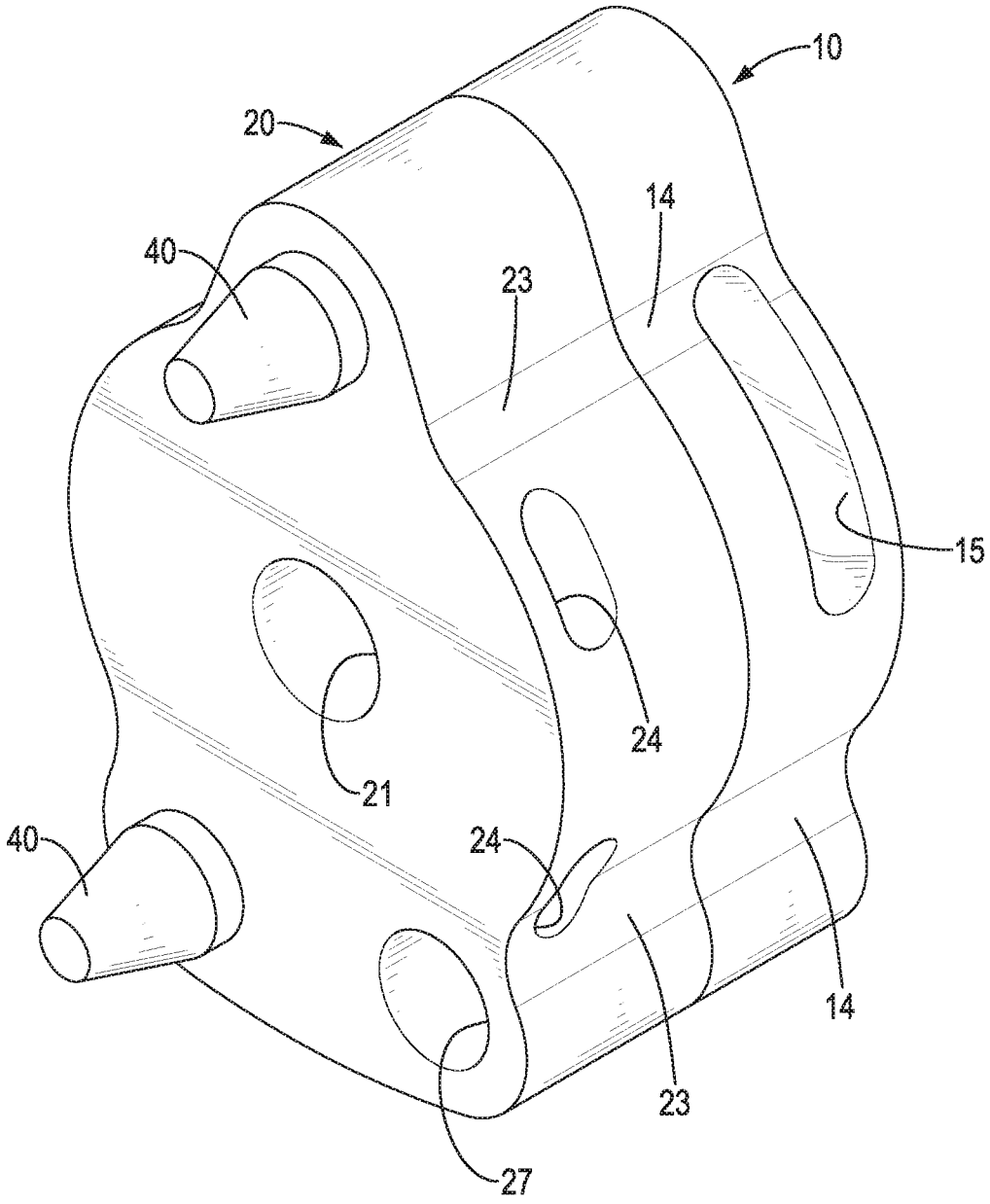
FIG. 1 is a perspective view of a valve seat in accordance with the present invention.
Figure 2:
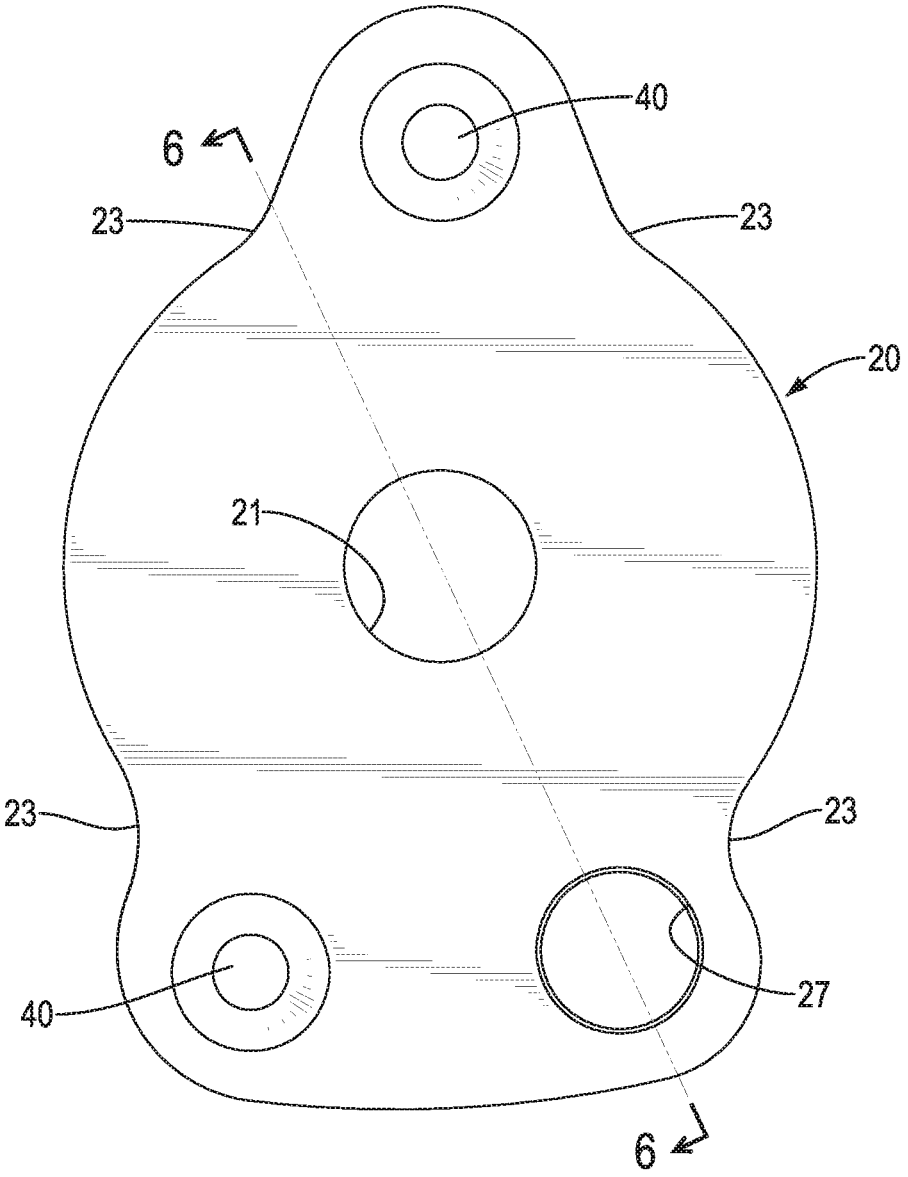
FIG. 2 is a front view of the valve seat in FIG. 1.
Figure 3:
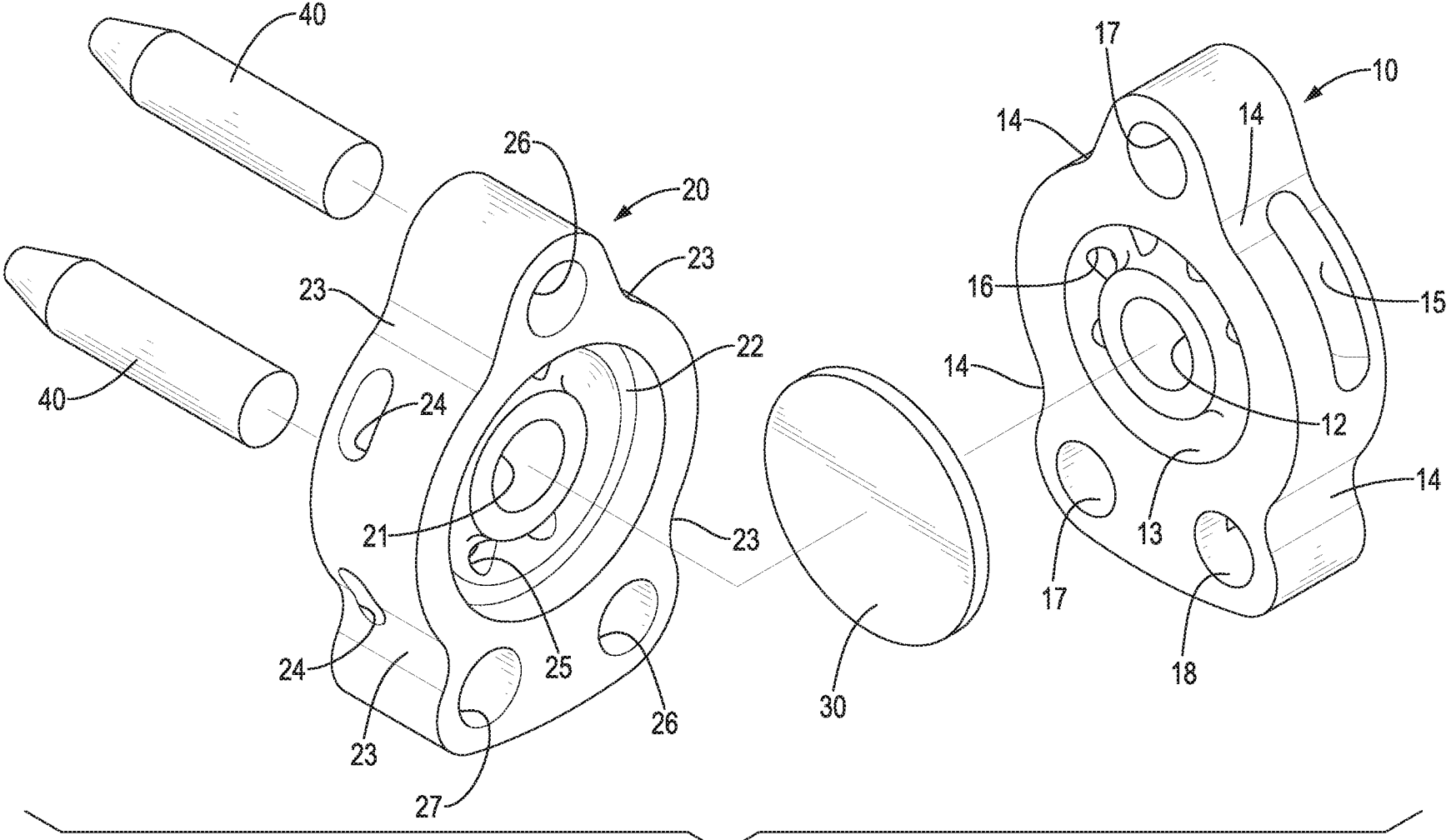
FIG. 3 is an exploded perspective view of the valve seat in FIG. 1.

With reference to FIGS. 1 and 3, a valve seat in accordance with the present invention has a first valve plate 10, a second valve plate 20, a valve disk 30, and two pins 40.

Figure 4:
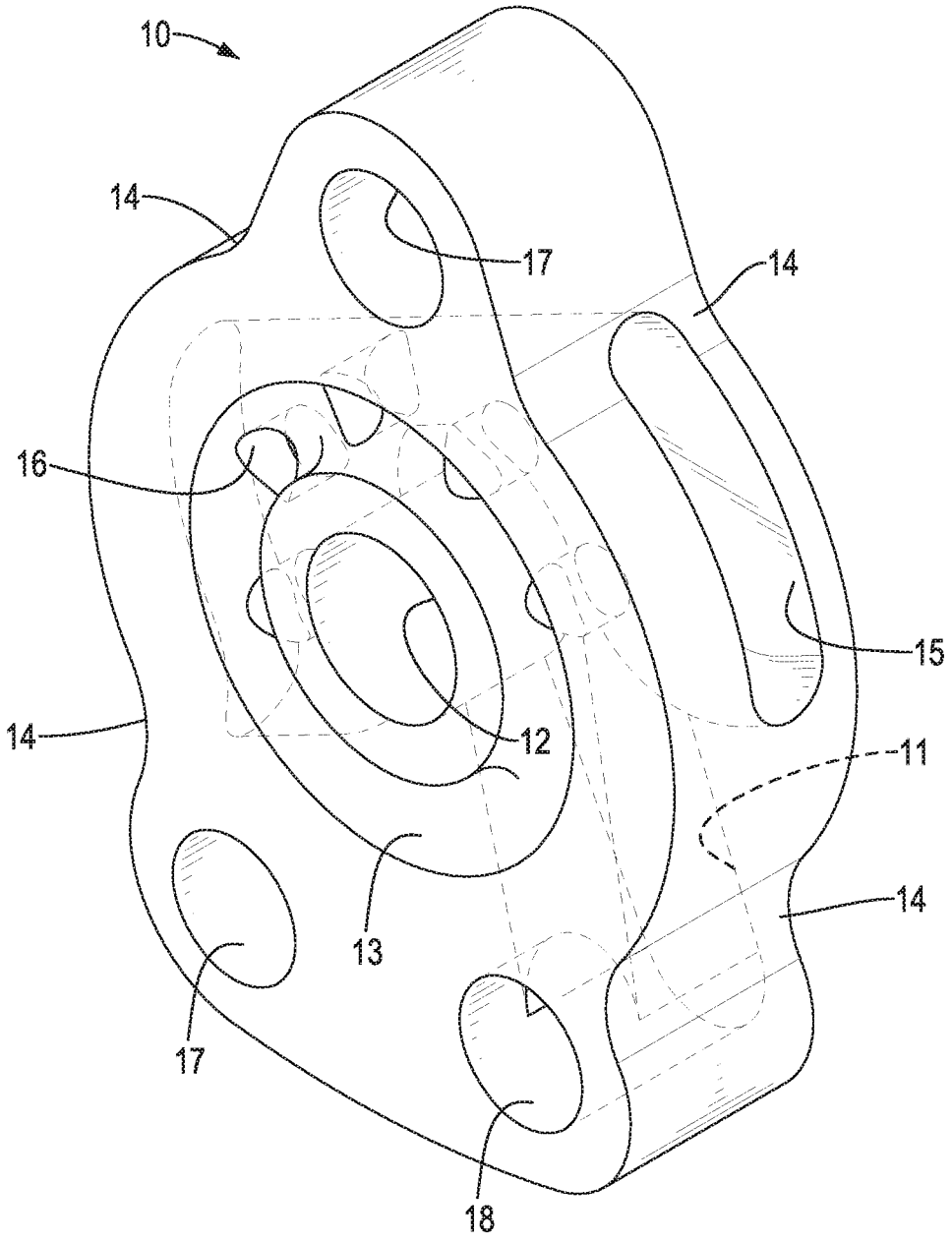
FIG. 4 is a perspective view of a rear valve plate in FIG. 3.

With reference to FIGS. 3 and 4, the first valve plate 10 has a front side, a rear side, a circumjacent surface, an entrance groove 11, a first central passage 12, a first trough 13, two pairs of first dents 14, an exhaust tunnel 15, five exhaust channels 16, two fastening holes 17, and a first flow hole 18. The front side and the rear side of the first valve plate 10 are opposite each other. The entrance groove 11 is defined in the rear side of the first valve plate 10. The first central passage 12 is formed through the front side of the first valve plate 10 and communicates with the entrance groove 11. The first trough 13 is annularly formed in the front side of the first valve plate 10 and surrounds the first central passage 12. Each pair of first dents 14 includes two first dents 14 formed in the circumjacent surface of the first valve plate 10. The exhaust tunnel 15 is defined through the circumjacent surface of the first valve plate 10 and has two exhaust openings disposed on the circumjacent surface of the first valve plate 10. The exhaust tunnel 15 obliquely extends. That is, one of the two exhaust openings of the exhaust tunnel 15 is adjacent to one of the two dents 14 of one of the two pairs of first dents 14, and the other one of the two exhaust openings of the exhaust tunnel 15 is adjacent to one of the two dents 14 of the other one of the two pairs of first dents 14. Each one of the two exhaust openings is an elongated opening. The five exhaust channels 16 are defined through a bottom of the first trough 13. The five exhaust channels 16 communicate with the first trough 13 and the exhaust tunnel 15. The amounts of the pair of first dents 14, the exhaust tunnel 15, and the exhaust channels 16 are not restricted. The two fastening holes 17 are defined in the front side of the first valve plate 10. The first flow hole 18 is defined in the front side of the first valve plate 10 and communicates with the entrance groove 11.

Figure 5:
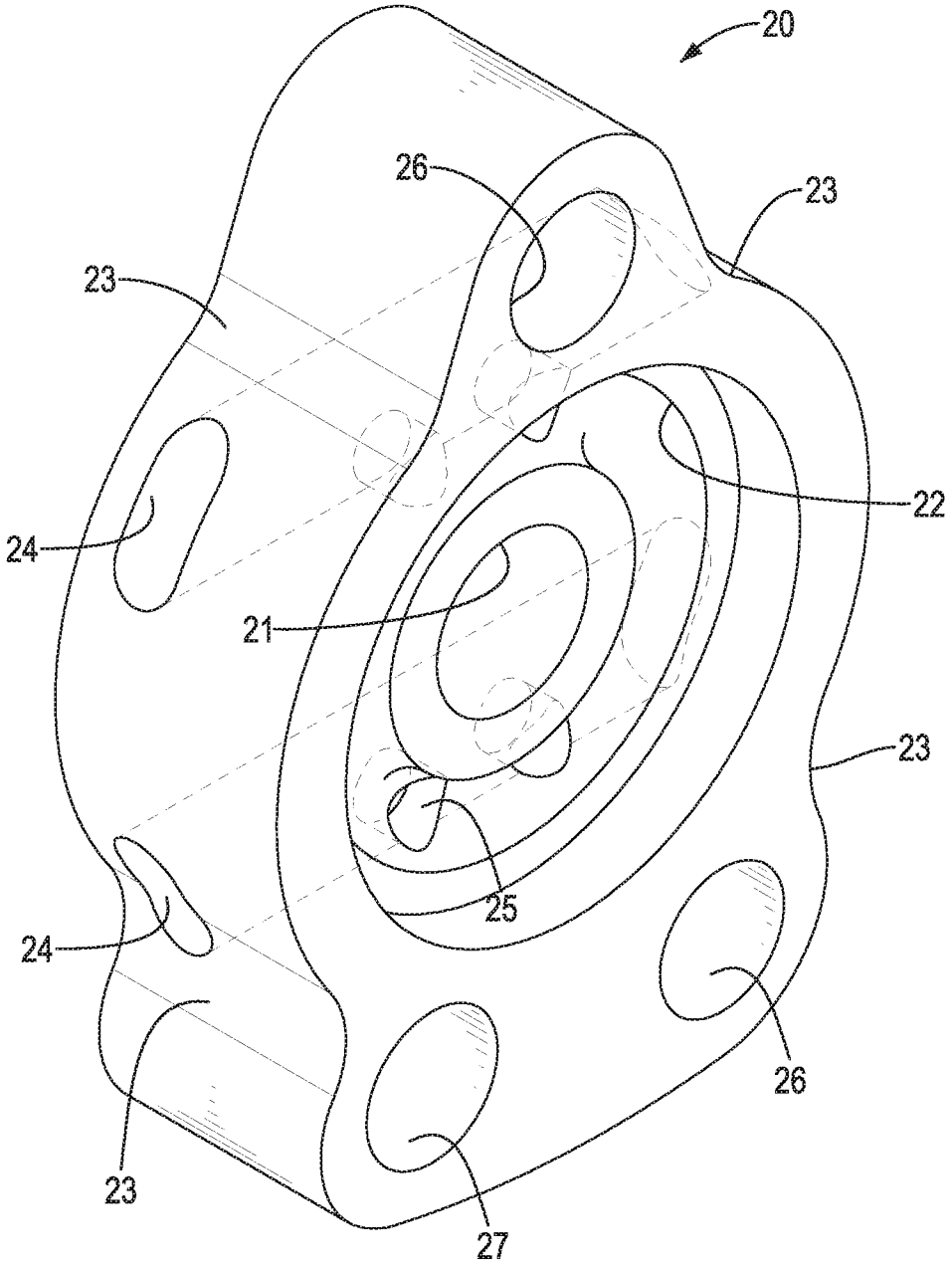
FIG. 5 is a perspective view of a front valve plate in FIG. 3.

With reference to FIGS. 1, 3, and 5, the second valve plate 20 is detachably connected to the first valve plate 10. The second valve plate 20 has a front side, a rear side, a circumjacent surface, a second central passage 21, a second trough 22, two pairs of second dents 23, two inlet tunnels 24, four inlet channels 25, two through holes 26, and a second flow hole 27. The front side and the rear side of the second valve plate 20 are opposite each other.

The second tough 22 is annularly formed in the rear side of the second valve plate 20. The second central passage 21 is formed through the front side and the rear side of the second valve plate 20 and is surrounded by the second tough 22. Each pair of second dents 23 includes two second dents 23 formed in the circumjacent surface of the second valve plate 20. Each inlet tunnel 24 is defined through the circumjacent surface of the second valve plate 20 and has two inlet openings disposed on the circumjacent surface of the second valve plate 20. Each inlet opening is an elongated opening. Each inlet tunnel 24 is disposed adjacent to a corresponding one of the two pairs of second dents 23. The two inlet openings of the inlet tunnel 24 are respectively adjacent to the two second dents 23 of the corresponding one of the two pairs of second dents 23. The four inlet channels 25 are defined through a bottom of the second trough 22. The four inlet channels 25 are divided into two groups of inlet channels 25 symmetrically disposed in a diametrical direction of the second trough 22. Each group of inlet channels 25 includes two inlet channels 25. The two inlet channels 25 of each group communicate with a corresponding one of the two inlet tunnels 24.

Each through hole 26 is formed through the front side and the rear side of the second valve plate 20. The second flow hole 27 is formed through the front side and the rear side of the second valve plate 20. The amounts of the pair of second dents 23, the inlet tunnels 24, the inlet channels 25, the through holes 26, and the second flow hole 27 are not restricted. In the embodiment of the present invention, when the first valve plate 10 is connected to the second valve plate 20, the two through holes 26 are respectively aligned and communicate with the two fastening holes 17, and the second flow hole 27 is aligned and communicates with the first flow hole 18.

Figure 6:
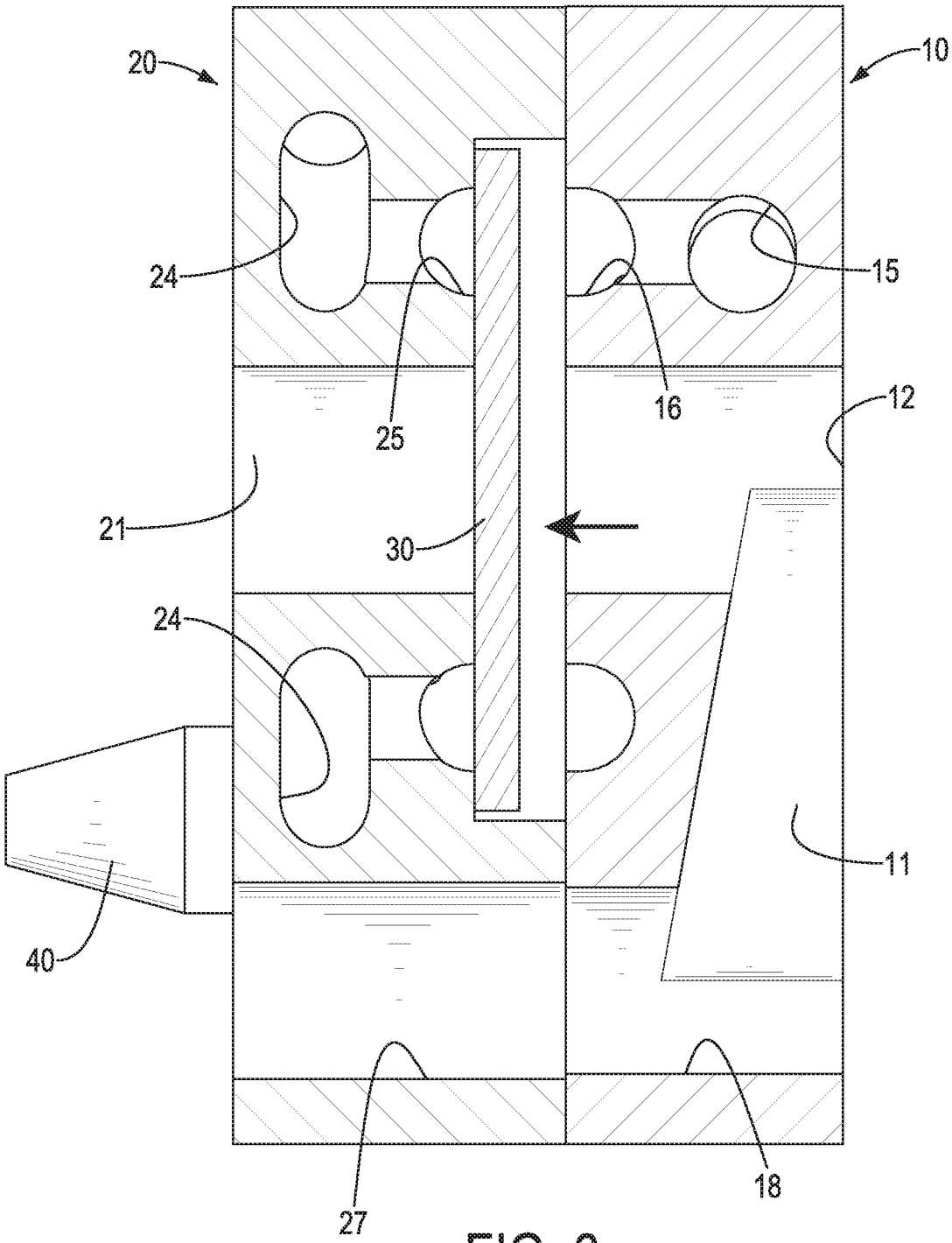
FIG. 6 is an operational cross sectional side view of the valve seat along line 6-6 in FIG. 2.

With reference to FIGS. 3 and 6, the valve disk 30 is disposed within the second trough 22. The valve disk 30 is driven by compressed gas and is capable of reciprocating between the first valve plate 10 and the second valve plate 20. The two pins 40 are respectively mounted through the two through holes 26 and are respectively inserted in the two fastening holes 17 to connect the first valve plate 10 with the second valve plate 20.

The amount of the pins 40 corresponds to the amounts of the fastening holes 17 and the through holes 26. The two pairs of first dents 14 correspond to the two pairs of second dents 23 in position. That is, the two first dents 14 of each pair of first dents 14 are respectively aligned with the two second dents 23 of a corresponding one of the two pairs of second dents 23.

Figure 8:
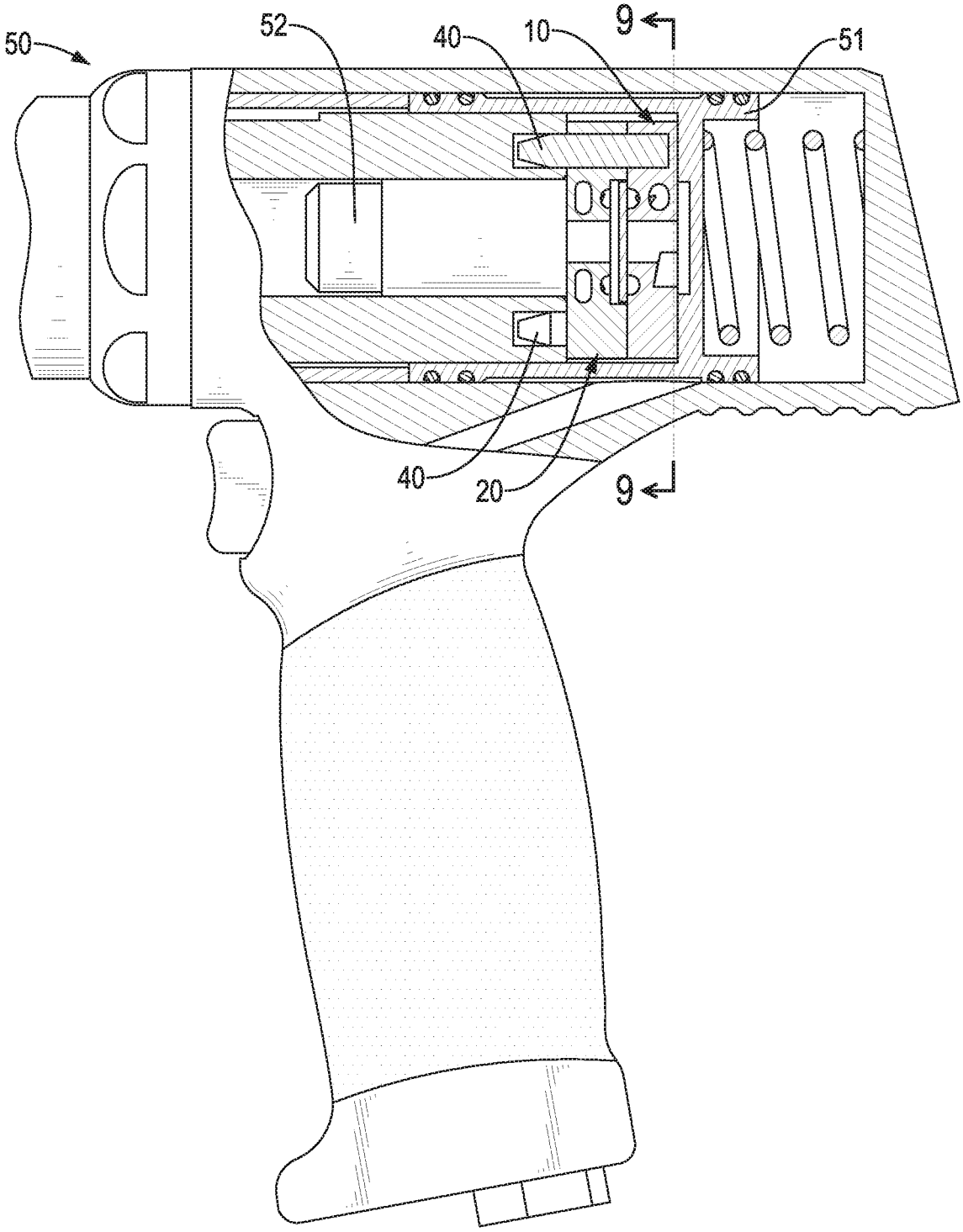
FIG. 8 is a side view in partial sectional of a pneumatic hammer with the valve seat in FIG. 1 mounted in a housing of the pneumatic hammer.
Figure 9:
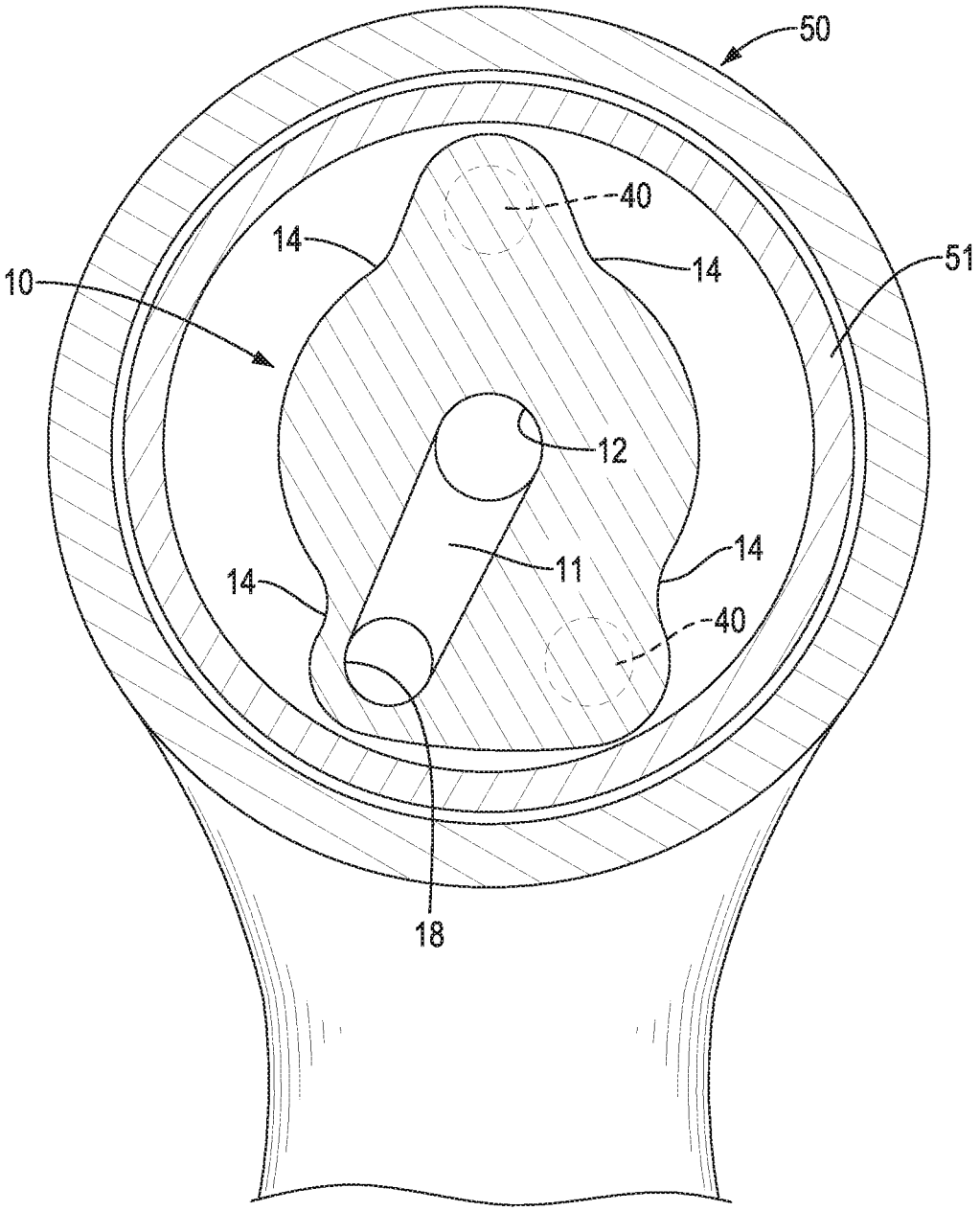
FIG. 9 is an end view in partial section of the pneumatic hammer along line 9-9 in FIG. 8.

With reference to FIGS. 8 and 9, the valve seat in accordance with the present invention is mounted in a housing 51 of a pneumatic hammer 50. The valve seat is fixed to the housing 51 by the two pins 40. The two first dents of each pair of first dents 14 respectively form two passages with the housing 51 of the pneumatic hammer 50. The two exhaust openings of the exhaust tunnel 15 respectively communicate with the two passages formed by the two first dents 14 of one of the two pairs of first dents 14. The two second dents 23 of each pair of second dents 23 respectively form two second passages with the housing 51. The two second passages formed by the two second dents 23 of each pair of second dents 23 communicate with the two first passages formed by the two first dents 14 of the corresponding pair of first dents 14.

With the FIG. 6, the compressed gas passes through the entrance groove 11, enters the first trough 13 via the first central passage 12, and pushes the valve disk 30 to move toward the second valve plate 20. The valve disk 30 blocks the second central passage 21 of the second valve plate 20. Therefore, the compressed gas cannot enter the second central passage 21 and the four inlet channels 25 of the second valve plate 20. The compressed gas enters the five exhaust channels 16 and then the exhaust tunnel 15. The compressed gas is discharged out of the first valve plate 10 from the two exhaust openings of the exhaust tunnel 15. The compressed gas then passes through the first passages and the second passages and enters the valve plate 20 via the two inlet tunnels 24.

Figure 7:
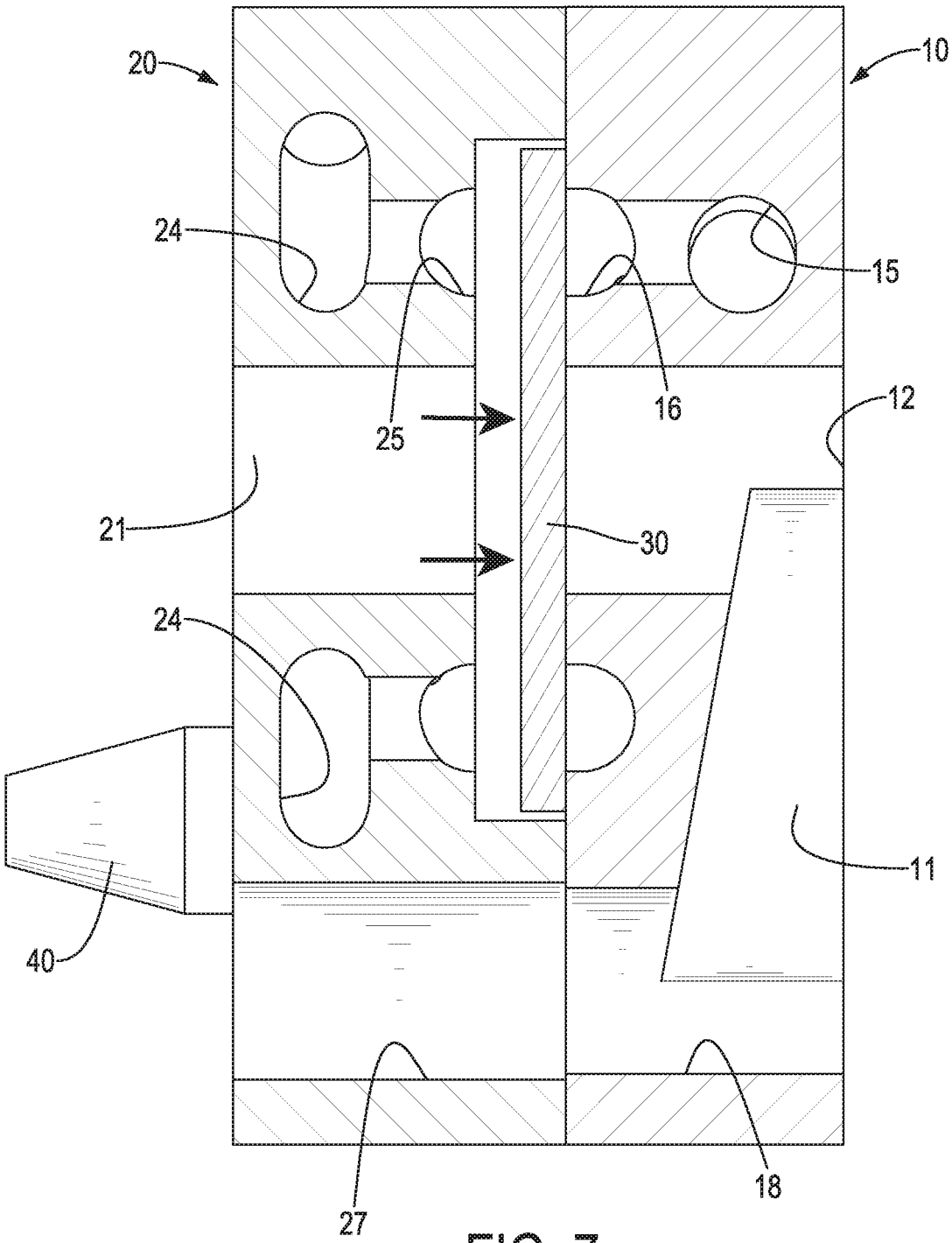
FIG. 7 is an operational cross sectional side view of the valve seat in FIG. 6.

With reference to FIG. 7, the compressed gas entering the two inlet tunnels 24 passes through the four inlet channels 25 to push the valve disk 30 toward the first valve plate 10 and then enters the second trough 22. The valve disk 30 pushed by the compressed gas blocks the first central passage 12 and the five exhaust channels 16. Therefore, the compressed gas passes through the second central passage 21 of the second valve plate 20 to push a hammer 52 mounted within the housing 51 away from the second valve plate 20. The manner in which the hammer 52 moves back to the second valve plate 20 is well known in the art and is only briefly described hereafter. The compressed gas also passes through the first flow hole 18 and the second flow hole 27 and enters a passageway within the housing 51 to push the hammer 52 back to the second valve plate 20.

With reference to FIG. 9, the two pairs of first dents 14 formed in the circumjacent surface of the first valve plate 10 and the two pairs of second dents 23 formed in the circumjacent surface of the second valve plate 20 form a large space between the valve plate and the housing 51. Thereby, the flow of the compressed gas passing through the exhaust tunnel 15 and the two inlet tunnels 24 is increased, and the force for pushing the valve disk 30 is increased as well. Therefore, the valve disk 30 is capable of agilely reciprocating between the first valve plate 10 and the second valve plate 20.

Each exhaust opening of the exhaust tunnel 15 is elongated, and each inlet opening of each inlet tunnel 24 is elongated. Therefore, the compressed gas can pass through the exhaust tunnel 15 and the inlet tunnels 24 easily. The exhaust openings and the inlet openings with elongated shapes also promote the agility of the movement of the valve disk 30.

With reference to FIG. 5, the two groups of inlet channels 25 are disposed symmetrically in the diametrical direction of the second trough 22, and each group of inlet channels 25 includes two inlet channels 25. Therefore, the flow of the compressed gas that enters the second trough 22 is increased. The valve disk 30 is evenly pushed by the compressed gas and can smoothly reciprocate between the first valve plate 10 and the second valve plate 20 without wedging. Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A valve seat adapted to be mounted within a housing of a pneumatic hammer, the valve seat comprising:

a first valve plate having two opposite sides;

a circumjacent surface;

a first trough annularly formed in one of the two opposite sides of the first valve plate;

at least one pair of first dents, each pair of first dents including two first dents formed in the circumjacent surface of the first valve plate; and at least one exhaust tunnel, each one of the at least one exhaust tunnel formed through the circumjacent surface of the first valve plate and having two exhaust openings disposed on the circumjacent surface of the first valve plate; and the two exhaust openings of each one of the at least one exhaust tunnel respectively disposed adjacent to the two first dents of one of the at least one pair of first dents; and a second valve plate detachably connected to the first valve plate and having two opposite sides;

a circumjacent surface;

a second trough annularly formed in one of the two opposite sides of the second valve plate facing to the first trough and communicating with the first trough;

at least one pair of second dents, each pair of second dents formed in the circumjacent surface of the second valve plate; and at least one inlet tunnel, each one of the at least one inlet tunnel formed through the circumjacent surface of the second valve plate and having two inlet openings disposed on the circumjacent surface of the second valve plate; and at least two inlet channels communicating with the second trough and the at least one inlet tunnel;

the two first dents of each pair of first dents respectively aligned with the two second dents of one of the at least one pair of second dents; and a valve disk disposed within the second trough and capable of reciprocating between the first valve plate and the second valve plate.

2. The valve seat as claimed in claim 1, wherein the at least one pair of first dents includes two pairs of first dents.

3. The valve seat as claimed in claim 2, wherein each one of the two exhaust openings of each one of the at least one exhaust tunnel is an elongated opening.

4. The valve seat as claimed in claim 3, wherein the first valve plate has at least two exhaust channels communicating with the at least one exhaust tunnel and the first trough.

5. The valve seat as claimed in claim 2, wherein the at least two inlet channels are divided into two groups of inlet channels; and the two groups of inlet channels are symmetrically disposed in a diametrical direction of the second trough.

6. The valve seat as claimed in claim 5, wherein each of the two groups of inlet channels includes at least two inlet channels.

7. The valve seat as claimed in claim 6, wherein the at least one inlet tunnel of the second valve plate includes two inlet tunnels; and the two inlet tunnels respectively communicate with the two groups of inlet channels.

8. The valve seat as claimed in claim 7, wherein the at least one pair of second dents includes two pairs of second dents.

9. The valve seat as claimed in claim 8, wherein each inlet opening is an elongated hole.

10. The valve seat as claimed in claim 3, wherein the at least two inlet channels are divided into two groups of inlet channels; and the two groups of inlet channels are symmetrically disposed in a diametrical direction of the second trough.

11. The valve seat as claimed in claim 10, wherein each of the two groups of inlet channels includes at least two inlet channels.

12. The valve seat as claimed in claim 11, wherein the at least one inlet tunnel of the second valve plate includes two inlet tunnels; and the two inlet tunnels respectively communicate with the two groups of inlet channels.

13. The valve seat as claimed in claim 12, wherein the at least one pair of second dents includes two pairs of second dents.

14. The valve seat as claimed in claim 13, wherein each inlet opening is an elongated hole.

15. The valve seat as claimed in claim 1, wherein the at least two inlet channels are divided into two groups of inlet channels; and the two groups of inlet channels are symmetrically disposed in a diametrical direction of the second trough.

16. The valve seat as claimed in claim 15, wherein each of the two groups of inlet channels includes at least two inlet channels.

17. The valve seat as claimed in claim 16, wherein the at least one inlet tunnel of the second valve plate includes two inlet tunnels; and the two inlet tunnels respectively communicate with the two groups of inlet channels.

18. The valve seat as claimed in claim 17, wherein the at least one pair of second dents includes two pairs of second dents.

19. The valve seat as claimed in claim 18, wherein each inlet opening is an elongated hole.

* * * * *